United States Patent [19]

Inaba

[11] Patent Number: 4,471,176

[45] Date of Patent: Sep. 11, 1984

[54] KEYBOARD SWITCH

[75] Inventor: Masaichi Inaba, Ibaraki, Japan

[73] Assignee: Nippon Mektron, Ltd., Japan

[21] Appl. No.: 489,774

[22] Filed: Apr. 29, 1983

[30] Foreign Application Priority Data

Apr. 30, 1982 [JP] Japan ..... 57-074000

[51] Int. Cl.[3] ..... H01H 13/70

[52] U.S. Cl. ..... 200/5 A; 200/159 B; 200/292

[58] Field of Search ..... 200/5 R, 5 A, 86 R, 200/159 B, 292

[56] References Cited

U.S. PATENT DOCUMENTS

| | | | |
|---|---|---|---|
| 3,392,247 | 7/1968 | Check | 200/86 R |
| 4,071,718 | 1/1978 | Harden | 200/5 A X |
| 4,237,351 | 12/1980 | Boulanger et al. | 200/5 A |
| 4,245,138 | 1/1981 | Harper | 200/5 A |
| 4,322,587 | 3/1982 | Burns et al. | 200/5 R |

*Primary Examiner*—J. R. Scott

*Attorney, Agent, or Firm*—Fishman & Dionne

[57] ABSTRACT

A snap action keyboard switch mechanism is presented wherein protrusions located on the switch sheet between adjoining snap action elements act to support the switch sheet and avoid inadvertent input. If a key is actuated off center, the support protrusions will prevent erroneous actuation of an adjoining key. The protrusion height varies depending upon the desired optimum tactility.

4 Claims, 2 Drawing Figures

KEYBOARD SWITCH

BACKGROUND OF THE INVENTION

This invention relates to the field of keyboard switch mechanisms. More particularly, this invention relates to a new and improved snap action or tactile keyboard switch mechanism in which the possibility of inadvertent key actuation is significantly reduced.

Snap action keyboard switch mechanisms of the general type of the present invention have found wide applicability as an operational input switch for various electric and electronic apparatus. Snap action switches are particularly effective because of a clicking action occurring during the switching operation. The clicking action enables the keyboard operator to confirm the input through variation in pressure felt in the finger known as tactile feel.

While conventional prior art tactile type keyboard switch structures have performed adequately, they have suffered from certain structural and operational problems. One such common deficiency occurs in the area located between the operational regions or keys. If the keyboard operator inadvertently presses a spot within this area, for example when a key is actuated off center, during the operation of the keyboard switch, one of the keys located adjacent to the pressed spot may erroneously be actuated. Consequently, this inadvertent actuation and input results in poor efficiency and frustration to the keyboard operator as well as misinformation and/or miscalculation in the supporting electric or electronic instruments.

SUMMARY OF THE INVENTION

The above-discussed and other deficiencies of the prior art are overcome or significantly reduced by the keyboard switch mechanism of the present invention. In accordance with the present invention, the area located between the operational regions or keys has a novel structural support. This support is accomplished by means of protrusions located on the switch sheet of the snap action keyboard. The protrusions are disposed beneath the non-operational regions, for example, between key locations. These protrusions act to alleviate the above-mentioned problems associated with inadvertent input caused by actuating the areas between the keys. The protrusions may be either formed in or mounted on the switch sheet. The protrusion height may vary depending on the distance between the operational regions in order to maintain optimum tactility.

The above-discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
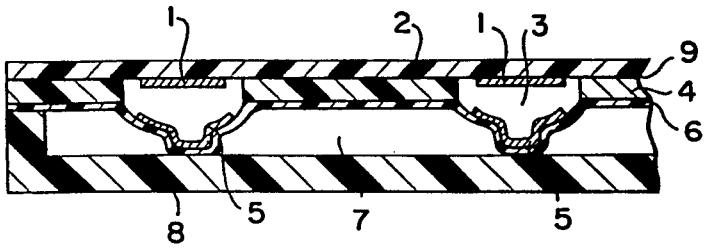
FIG. 1 PRIOR ART
FIG. 1 is a cross-sectional elevation view of a conventional snap action keyboard in accordance with the prior art.

Referring first to FIG. 1, a snap action keyboard switch in accordance with the prior art is shown. A resilient and flexible circuit sheet 2 having a desired fixed upper circuit contact patterns 1 formed thereon is shown. A resilient and flexible switch sheet 6 having a movable lower circuit contact patterns 5 formed thereon and corresponding to the upper contact patterns 1 is disposed beneath circuit sheet 2 across switch cavities 3. Circuit sheet 2 and switch sheet 6 are separated by an insulating spacer 4 having openings which define switch cavities 3. Adhesive layers 9, one of which is indicated, bond the circuit layers together. A pair of contacts 1 and 5 constitutes a key site. The space 7 between key sites contribute to the snap action effect. The keyboard structure is completed by a rigid base sheet 8 which accommodates and supports switch sheet 6.

In a known prior art embodiment, the individual switch elements formed in switch sheet 6, a semispherical, flat-topped shape is positioned below contact elements 1 and is suitable for initiating the desired snap or click action. These switch elements in switch sheet 6 invert upon actuation of cover sheet 2 by application of a downward force at the location of a circuit pattern 1 of a key site. Upon inversion of the switch elements, tactile snap action is translated to the keyboard operator while simultaneously the upper contact pattern 1 comes into electrical and mechanical contact with the lower contact pattern 5 thus closing a switch.

The non-conductive keyboard parts are typically made from an insulating synthetic material while the electrically conductive circuit patterns may be formed by any conventional printed circuit or similar technique.

As discussed earlier, the above described prior art device suffers from certain deficiencies. In particular, the area between the individual snap action elements corresponding to the portion of cover sheet 2 located above space 7 is susceptible to erroneous input by inadvertent application of actuating force. Thus, when a keyboard operator accidently presses this area suring operation, one of the adjoining key elements may snap through causing unintended input.

Figure 2:
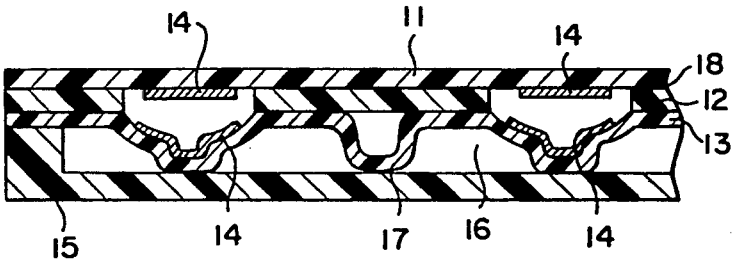
FIG. 2 is a cross-sectional elevation view of a snap action keyboard in accordance with the present invention.

The keyboard switch of the present invention as shown in FIG. 2 eliminates the above-described problem. The keyboard of the present invention has a structure similar to that already described in FIG. 1. It includes a cover sheet 11 with a fixed upper circuit contact patterns 14 formed thereon. A switch sheet 13 with both snap action switch elements and support protrusions 17 formed therein is disposed beneath cover sheet 11. The switch elements are shaped similarly to the switch elements in FIG. 1 and have movable lower circuit contact patterns 14A formed thereon and corresponding to the upper contact patterns 14. Lastly, an insulating spacer sheet 12, base sheet 15 and bonding layers 18 (only one of which is shown) complete the component parts of the present invention. The keyboard shown in FIG. 2 operates in a henerally similar manner to the prior art keyboard shown in FIG. 1 in that the semispherical, flat-topped switch elements in switch sheet 13 invert upon actuation of cover sheet 11 by application of actuating force downwardly at a switch site. Similarly, upon inversion, a tactile snap action is translated to the operator as the upper contact pattern 14 comes into mechanical and electrical contact with the lower contact pattern 14A thus closing a switch.

Unlike the prior art switch, the switch sheet 13 is provided with structural supports in the form of support protrusions 17. The protrusions 17 may be either integrally formed into or attached onto the switch sheet 13. The protrusions 17 are disposed beneath the cover sheet 11 between the operational regions or keys, thereby supporting the switch sheet against accidental actuation when pressure is inadvertently applied to this non-operational area by the keyboard operator. Thus, the keyboard of the present invention reduces the likelihood of input error from inadvertent key actuation.

Experimentation has shown that if the distance between the keys or operating regions is short and if the height of the protrusions 17 are equal to the depth of the individual switch elements of the switch sheet 13, then the actuating force, for example, force needed by operator to fully depress the key, and the snap action return force are increased. Actually, the increase in return force is relatively greater than the corresponding increase in actuating force. The "click ratio" which is a measure of the degree of tactility and which is represented by:

$$\frac{\text{ACTUATING FORCE} - \text{RETURN FORCE}}{\text{ACTUATING FORCE}} = \text{CLICK RATIO}$$

is therefore reduced with the relatively increased return force. Since tactile feel is highly desired and a lower click ratio indicates less tactile feel, then the above hypothetical dimensional relationship should be avoided. This is easily accomplished by making the height of the protrusion 17 shorter than the depth of the individual switch elements. Thus, a satisfactory click ratio is obtained while maintaining the desired effect of the support protrusions 17. Also, tactile feel of a switch can be adjusted or varied in the design stage by the proportioning of the height of protrusions 17 and the depth of switch elements.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A keyboard comprising:

a first flexible circuit sheet;

a first contact pattern on one side of said circuit sheet;

a flexible switch sheet;

a plurality of movable snap action elements formed in said switch sheet;

a second contact pattern on said snap action elements, said second contact pattern facing and corresponding to said first contact pattern;

a plurality of support protrusions formed in and extending from said switch sheet;

said protrusions being located between said snap action elements and extending to said first circuit sheet; and a base sheet supporting said switch sheet.

2. The keyboard of claim 1 including:

spacer means separating said switch sheet and said cover sheet.

3. The keyboard of claim 1 wherein:

said snap action element is in the shape of a semi-spherical dome having a flat top.

4. The keyboard of claim 1 wherein:

the height of said protrusions are less than the depth of said switch elements.

* * * * *